US009620876B2

(12) United States Patent
Leibold et al.

(10) Patent No.: US 9,620,876 B2
(45) Date of Patent: Apr. 11, 2017

(54) ELECTRICAL CONNECTOR HAVING ELECTRICAL CONTACTS THAT INCLUDE A PORE-BLOCKING SUBSTANCE

(71) Applicant: Tyco Electronics Corporation, Berwyn, PA (US)

(72) Inventors: Kevin Ray Leibold, New Cumberland, PA (US); Justin Shane McClellan, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 346 days.

(21) Appl. No.: 14/321,499

(22) Filed: Jul. 1, 2014

(65) Prior Publication Data

US 2016/0006166 A1 Jan. 7, 2016

(51) Int. Cl.

| | |
|---|---|
| ***H01R 13/03*** | (2006.01) |
| *H01R 107/00* | (2006.01) |
| *H01R 13/6587* | (2011.01) |

(52) U.S. Cl.

CPC ..... *H01R 13/03* (2013.01); *H01R 13/6587* (2013.01); *H01R 2107/00* (2013.01)

(58) Field of Classification Search

CPC H01R 13/03; H01R 13/6587; H01R 2107/00; H05K 3/28; Y10S 439/936

USPC ..... 439/519, 524, 886, 936

See application file for complete search history.

(56) References Cited

U.S. PATENT DOCUMENTS

| | | | | |
|---|---|---|---|---|
| 3,482,202 | A * | 12/1969 | Wallace et al. | H01H 1/60 29/622 |
| 5,307,242 | A * | 4/1994 | Seibold | H01R 23/6873 361/785 |
| 6,139,366 | A * | 10/2000 | van Woensel | H01R 13/518 439/108 |
| 6,218,031 | B1 * | 4/2001 | Shintani | C23F 11/165 205/317 |
| 7,837,514 | B2 * | 11/2010 | Fogg | H01R 13/514 439/701 |
| 7,976,321 | B2 * | 7/2011 | Schempp | H01R 13/514 439/108 |
| 8,188,392 | B2 * | 5/2012 | Isberg | H01H 1/06 200/279 |
| 8,579,636 | B2 * | 11/2013 | Davis | H01R 12/7082 439/65 |
| 2015/0288121 | A1 * | 10/2015 | Holzapfel | H01R 39/22 439/3 |

(Continued)

*Primary Examiner* — Tulsidas C Patel
*Assistant Examiner* — Travis Chambers

(57) ABSTRACT

Electrical connector including a connector housing that is configured to engage a mating connector during a mating operation. The electrical connector also includes a plurality of electrical contacts that coupled to the connector housing. Each of the electrical contacts includes a proximal base that is coupled to the connector housing and an elongated body that extends from the proximal base to a distal end. The elongated body has a body side that extends between the proximal base and the distal end and is configured to engage a corresponding mating contact of the mating connector. The body side has a stamped indentation, wherein each of the electrical contacts includes a pore-blocking substance within the corresponding stamped indentation and along a surrounding portion of the exterior surface that is adjacent to the corresponding stamped indentation.

20 Claims, 5 Drawing Sheets

(56) References Cited

U.S. PATENT DOCUMENTS

2015/0333425 A1* 11/2015 Takahashi ..... H01R 13/03
439/887

* cited by examiner

ELECTRICAL CONNECTOR HAVING ELECTRICAL CONTACTS THAT INCLUDE A PORE-BLOCKING SUBSTANCE

BACKGROUND OF THE INVENTION

The subject matter herein relates generally to electrical connectors having electrical contacts that engage corresponding mating contacts of another electrical connector.

Electrical connectors are used to transmit data and/or power in various industries. The electrical connectors are often configured to repeatedly engage and disengage complementary electrical connectors. The process of mating the electrical connectors may be referred to as a mating operation. For example, in a backplane communication system, a backplane circuit board has a header connector that is configured to mate with a receptacle connector. The receptacle connector is typically mounted to a daughter card. The header connector includes an array of electrical contacts (hereinafter referred to as "header contacts"), and the receptacle connector includes a complementary array of electrical contacts (hereinafter referred to as "receptacle contacts"). During the mating operation, the receptacle contacts mechanically engage and slide along the corresponding header contacts. The sliding engagement between the receptacle and header contacts may be referred to as wiping, because each receptacle contact wipes along an exterior surface of the corresponding header contact.

Electrical contacts are often plated to enhance performance and/or durability of the electrical contact. For example, electrical contacts used to transmit data signals may include one or more underlying contact materials and a layer of gold plating that covers the underlying contact material(s). Gold plating is generally inert and does not react with the surrounding environment. Consequently, the gold plating can protect the underlying material(s) of the electrical contact. Gold plating, however, may include pores that form during the plating process. The pores may expose the underlying material(s) to corrosive agents and may negatively affect electrical performance. To address these problems, the gold plating is often coated with a corrosion prevention compound, which is hereinafter referred to as a pore-blocking substance. The pore-blocking substance may include organic materials (e.g., non-metallic materials) and may impede or inhibit the development of corrosion through the pores.

The pore-blocking substance, however, may be inadvertently removed from the electrical contacts during the manufacture of the electrical connectors and/or during operation of the electrical connectors. For example, the sheet metal from which the electrical contacts are formed may be coupled to an interleaving paper that separates adjacent coiled layers of the sheet metal when the sheet metal is rolled. When the interleaving paper is removed, the pore-blocking substance may be removed with the paper. Also, when the electrical connectors are assembled, the pore-blocking substance may be removed when the electrical contacts engage portions of the connector housing or other objects. Furthermore, the pore-blocking substance may be removed during a mating operation between electrical connectors and/or evaporate during operation of the electrical connectors. When the amount of the pore-blocking substance is reduced, the electrical contacts may be more susceptible to damage.

Accordingly, a need remains for electrical contacts that maintain a sufficient amount of pore-blocking substance along an exterior surface of the electrical contacts.

BRIEF DESCRIPTION OF THE INVENTION

In an embodiment, an electrical connector is provided that includes a connector housing that is configured to engage a mating connector during a mating operation. The electrical connector also includes a plurality of electrical contacts that coupled to the connector housing. Each of the electrical contacts includes a proximal base that is coupled to the connector housing and an elongated body that extends from the proximal base to a distal end. The elongated body has a body side that extends between the proximal base and the distal end and is configured to engage a corresponding mating contact of the mating connector. The body side has an indentation, wherein each of the electrical contacts includes a pore-blocking substance within the corresponding indentation.

In some aspects, the body side includes a sidewall that partially defines the indentation, and a contact area that is configured to directly engage the mating contact. The sidewall and the contact area are joined by a transition area of the body side that is shaped to permit wicking of the pore-blocking substance from the indentation to the contact area.

In some aspects, the body side is defined between opposite side edges and includes a contact area that extends between one of the side edges and the indentation. The body side is shaped such that the mating contact engages the contact area and extends at least partially over the indentation. In certain aspects, the body side has a centerline that extends between the side edges. The centerline may extend through the indentation.

In some aspects, the mating contact is configured to engage the body side at a contact zone that includes the indentation. The contact zone may include first and second contact areas that are located on opposite sides of the indentation. The first and second contact areas may coincide with a common plane.

In an embodiment, a communication system is provided that includes a receptacle connector having a plurality of receptacle contacts and a header connector having a plurality of header contacts. The header contacts are configured to engage corresponding receptacle contacts of the receptacle connector during a mating operation between the receptacle and header connectors. Each of the header contacts includes a proximal base and an elongated body that extends from the proximal base to a distal end. The elongated body has a body side that extends between the proximal base and the distal end and is configured to engage a corresponding receptacle contact of the receptacle connector. The body side has an indentation, wherein each of the header contacts includes a pore-blocking substance within the corresponding indentation.

In some aspects, the body side is defined between opposite side edges of the corresponding header contact and includes a contact area that extends between one of the side edges and the indentation. The corresponding receptacle contact may engage the contact area and extend at least partially over the indentation when the receptacle and header connectors are fully mated. Optionally, the receptacle contacts may wipe along the body sides of the corresponding header contacts as the receptacle and header connectors are mated.

In an embodiment, an electrical contact includes a proximal base that is configured to couple to a connector housing and an elongated body that extends from the proximal base to a distal end. The elongated body has a body side that extends between the proximal base and the distal end and is configured to engage a corresponding mating contact. The body side has an indentation, wherein each of the electrical contacts includes a pore-blocking substance within the corresponding indentation.

DETAILED DESCRIPTION OF THE INVENTION

Embodiments set forth herein may include electrical contacts, electrical connectors having the electrical contacts, and communication systems having the electrical connectors. Embodiments include electrical contacts that may be configured to hold or retain a greater amount of a pore-blocking substance along an exterior surface of the electrical contact. Although the illustrated embodiment includes electrical connectors that are used in high-speed communication systems, such as backplane or midplane communication systems, it should be understood that embodiments may be used in other communication systems or in other systems/devices that utilize electrical contacts. Accordingly, the inventive subject matter is not limited to the illustrated embodiment.

In order to distinguish similar elements in the detailed description and claims, various labels may be used. For example, an electrical connector may be referred to as a header connector, a receptacle connector, or a mating connector. Electrical contacts may be referred to as header contacts, receptacle contacts, or mating contacts. When similar elements are labeled differently (e.g., receptacle contacts and mating contacts), the different labels do not necessarily require structural differences. For instance, in some embodiments, the receptacle contacts described herein may be referred to as mating contacts.

As used herein, the phrase "a plurality of electrical contacts" when used in the detailed description or the claims does not necessarily refer to each and every electrical contact of an electrical connector. For example, a contact array may include a first plurality of electrical contacts and a second plurality of electrical contacts. The first plurality may have certain features, such as indentations, that the second plurality does not have.

Figure 1:
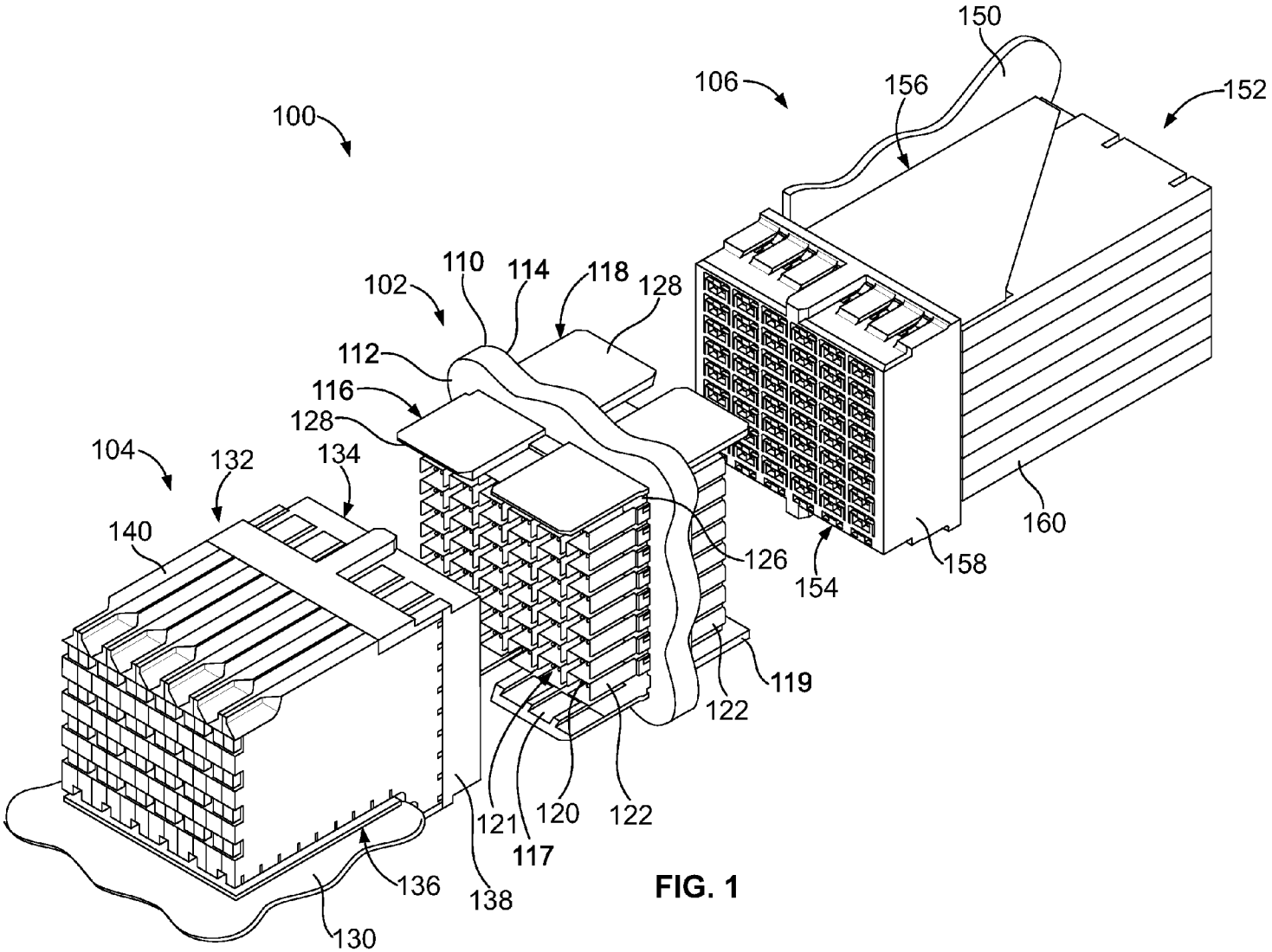
FIG. 1 is a front perspective view of a communication system formed in accordance with an embodiment.

FIG. 1 is a perspective view of a communication system 100 formed in accordance with an embodiment. In particular embodiments, the communication system 100 may be a backplane or midplane communication system. The communication system 100 includes a circuit board assembly 102, a first connector system (or assembly) 104 configured to be coupled to one side of the circuit board assembly 102 and a second connector system (or assembly) 106 configured to be coupled to an opposite side the circuit board assembly 102. The circuit board assembly 102 is used to electrically connect the first and second connector systems 104, 106. Optionally, the first and second connector systems 104, 106 may be line cards or switch cards. Although the communication system 100 is configured to interconnect two connector systems in the illustrated embodiment, other communication systems may interconnect more than two connector systems or, alternatively, interconnect a single connector system to another communication device.

The circuit board assembly 102 includes a circuit board 110 having a first board side 112 and second board side 114. In some embodiments, the circuit board 110 may be a backplane circuit board, a midplane circuit board, or a motherboard. The circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. The first and second header connectors 116, 118 include connector housings 117, 119, respectively. The first and second header connectors 116, 118 also include corresponding electrical contacts 120 that are electrically connected to one another through the circuit board 110. The electrical contacts 120 are hereinafter referred to as header contacts 120.

The circuit board assembly 102 includes a plurality of signal paths therethrough defined by the header contacts 120 and conductive vias 170 (shown in FIG. 2) that extend through the circuit board 110. The header contacts 120 of the first and second header connectors 116, 118 may be received in the same conductive vias 170 to define a signal path directly through the circuit board 110. In an exemplary embodiment, the signal paths pass straight through the circuit board assembly 102 in a linear manner. Alternatively, the header contacts 120 of the first header connector 116 and the header contacts 120 of the second header connector 118 may be inserted into different conductive vias 170 that are electrically coupled to one another through traces (not shown) of the circuit board 110.

The first and second header connectors 116, 118 include ground shields or contacts 122 that provide electrical shielding around corresponding header contacts 120. In an exemplary embodiment, the header contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides.

The connector housings 117, 119 couple to and hold the header contacts 120 and the ground shields 122 in designated positions relative to each other. The connector housings 117, 119 may be manufactured from a dielectric material, such as a plastic material. Each of the connector housings 117, 119 includes a mounting wall 126 that is configured to be mounted to the circuit board 110 and shroud walls 128 that extend from the mounting wall 126. The shroud walls 128 cover portions of the header contacts 120 and the ground shields 122.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is oriented perpendicular to the mating interface 134. When the first receptacle connector 132 is coupled to the first header connector 116, the first circuit board 130 is oriented perpendicular to the circuit board 110.

The first receptacle connector 132 includes a front housing or shroud 138. The front housing 138 is configured to hold a plurality of contact modules 140 side-by-side. As shown, the contact modules 140 are held in a stacked configuration generally parallel to one another. In some embodiments, the contact modules 140 hold a plurality of electrical contacts 142 (shown in FIGS. 3 and 4) that are electrically connected to the first circuit board 130. The electrical contacts 142 are hereinafter referred to as receptacle contacts 142. The receptacle contacts 142 are configured to be electrically connected to the header contacts 120 of the first header connector 116.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is oriented perpendicular to the mating interface 154. When the second receptacle connector 152 is coupled to the second header connector 118, the second circuit board 150 is oriented perpendicular to the circuit board 110.

Figure 3:
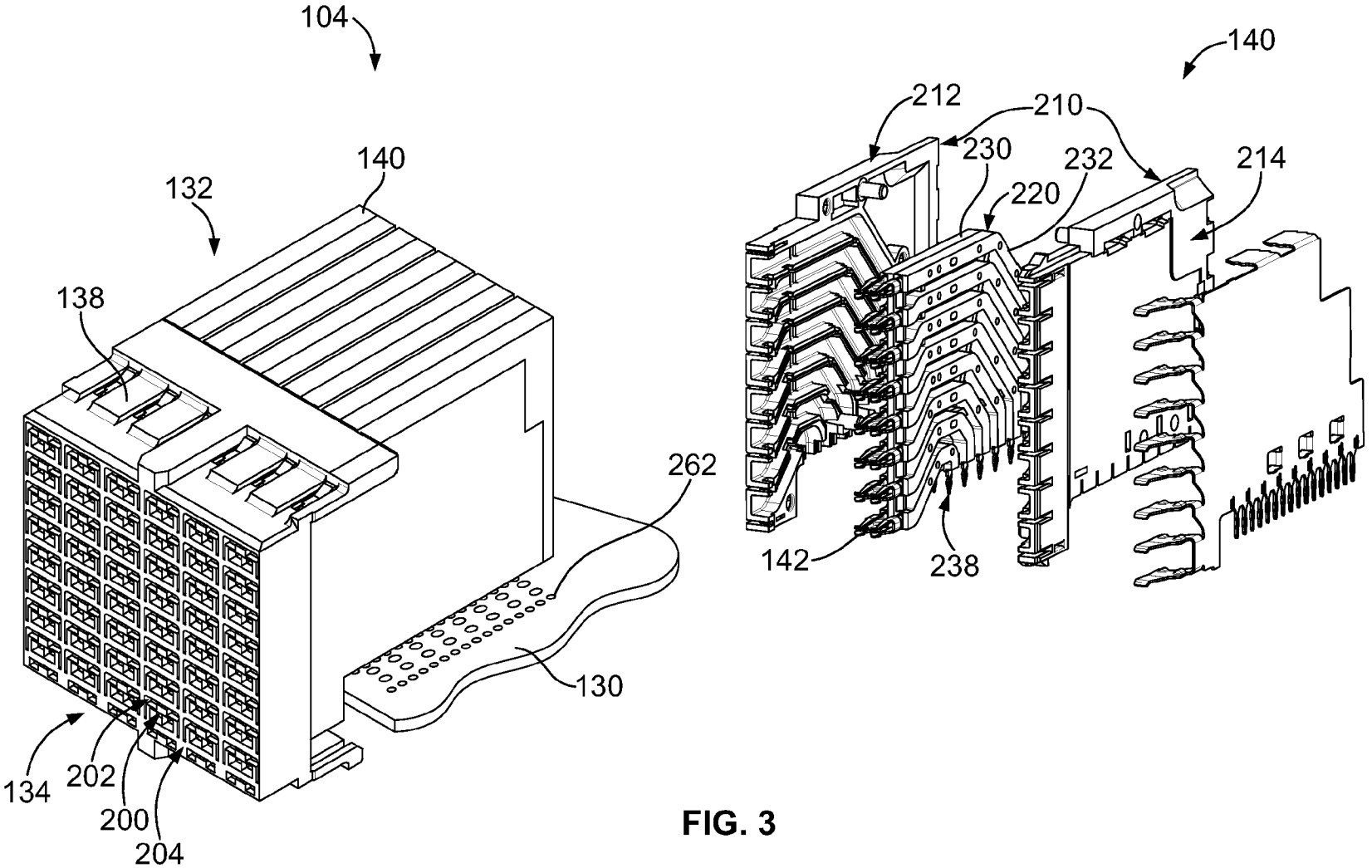
FIG. 3 is a perspective view of a receptacle connector that may be used with the communication system of FIG. 1.

Similar to the first receptacle connector 132, the second receptacle connector 152 includes a front housing 158 used to hold a plurality of contact modules 160. The contact modules 160 are held in a stacked configuration generally parallel to one another. The contact modules 160 hold a plurality of receptacle contacts (not shown) that are electrically connected to the second circuit board 150. The receptacle contacts are configured to be electrically connected to the header contacts 120 of the second header connector 118. The receptacle contacts of the contact modules 160 may be similar or identical to the receptacle contacts 142 (FIG. 3).

In the illustrated embodiment, the first circuit board 130 is oriented generally horizontally. The contact modules 140 of the first receptacle connector 132 are oriented generally vertically. The second circuit board 150 is oriented generally vertically. The contact modules 160 of the second receptacle connector 152 are oriented generally horizontally. As such, the first connector system 104 and the second connector system 106 may have an orthogonal orientation with respect to one another.

Although not shown, in some embodiments, the communication system 100 may include a loading mechanism. The loading mechanism may include, for example, latches or levers that fully mate the corresponding receptacle and header connectors. For instance, the loading mechanism may be operably coupled to the receptacle connector 132 and, when actuated, drive the receptacle connector 132 into the header connector 116 to assure that the receptacle and header connectors 132, 116 are fully mated.

Figure 2:
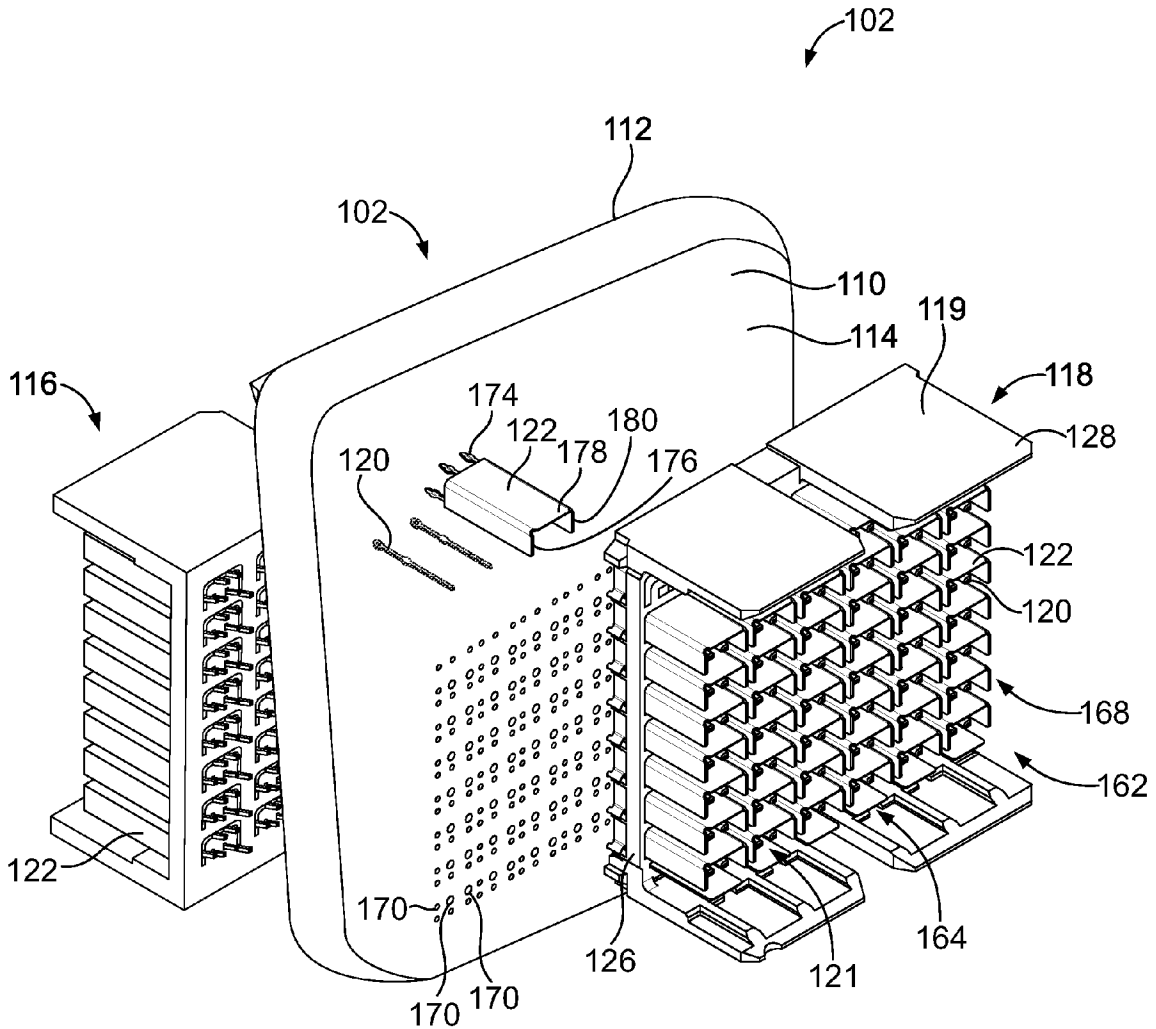
FIG. 2 is a perspective view of a circuit board assembly including a header connector that may be used with the communication system of FIG. 1.

FIG. 2 is a partially exploded view of the circuit board assembly 102 showing the first and second header connectors 116, 118 positioned for mounting to the circuit board 110. Although the following description is with respect to the second header connector 118, the description is also applicable to the first header connector 116. As shown, the connector housing 119 includes a front end 162 that faces away from the second board side 114 of the circuit board 110. The connector housing 119 defines a housing cavity 164 that opens to the front end 162 and is configured to receive the second receptacle connector 152 (FIG. 1) when the second receptacle connector 152 is advanced into the housing cavity 164. As shown, the second header connector 118 includes a contact array 168 that includes the header contacts 120 and the ground shields 122. The contact array 168 may include multiple signal pairs 121.

The conductive vias 170 extend into the circuit board 110. In an exemplary embodiment, the conductive vias 170 extend entirely through the circuit board 110 between the first and second board sides 112, 114. In other embodiments, the conductive vias 170 extend only partially through the circuit board 110. The conductive vias 170 are configured to receive the header contacts 120 of the first and second header connectors 116, 118. For example, the header contacts 120 include compliant pins 172 that are configured to be loaded into corresponding conductive vias 170. The compliant pins 172 mechanically engage and electrically couple to the conductive vias 170. Likewise, at least some of the conductive vias 170 are configured to receive compliant pins 174 of the ground shields 122. The compliant pins 174 mechanically engage and electrically couple to the conductive vias 170. The conductive vias 170 that receive the ground shields 122 may surround the pair of conductive vias 170 that receive the corresponding pair of header contacts 120.

The ground shields 122 are C-shaped and provide shielding on three sides of the signal pair 121. The ground shields 122 have a plurality of walls, such as three planar walls 176, 178, 180. The planar walls 176, 178, 180 may be integrally formed or alternatively, may be separate pieces. The compliant pins 174 extend from each of the planar walls 176, 178, 180 to electrically connect the planar walls 176, 178, 180 to the circuit board 110. The planar wall 178 defines a center wall or top wall of the ground shield 122. The planar walls 176, 180 define side walls that extend from the planar wall 178. The planar walls 176, 180 may be generally perpendicular with respect to the planar wall 178. In alternative embodiments, other configurations or shapes for the ground shields 122 are possible in alternative embodiments. For example, more or fewer walls may be provided in alternative embodiments. The walls may be bent or angled rather than being planar. In other embodiments, the ground shields 122 may provide shielding for individual header contacts 120 or sets of contacts having more than two header contacts 120.

FIG. 3 is a partially exploded view of the first connector system 104 including the first receptacle connector 132. Although the following description is with respect to the first receptacle connector 132, the description is also applicable to the second receptacle connector 152 (FIG. 1). FIG. 3 illustrates one of the contact modules 140 in an exploded state. The front housing 138 includes a plurality of contact openings 200, 202 at a front end 204 of the front housing 138. The front end 204 defines the mating interface 134 of the first receptacle connector 132 that engages the first header connector 116 (FIG. 1).

The contact modules 140 are coupled to the front housing 138 such that the receptacle contacts 142 are received in corresponding contact openings 200. Optionally, a single receptacle contact 142 may be received in each contact opening 200. The contact openings 200 may be configured to receive corresponding header contacts 120 (FIG. 1) therein when the receptacle and header connectors 132, 116 are mated. The contact openings 202 receive corresponding ground shields 122 (FIG. 1) therein when the receptacle and header connectors 132, 116 are mated.

The front housing 138 may be manufactured from a dielectric material, such as a plastic material, and may provide isolation between the contact openings 200 and the contact openings 202. The front housing 138 may isolate the receptacle contacts 142 and the header contacts 120 from the ground shields 122. In some embodiments, the contact module 140 includes a conductive holder 210. The conductive holder 210 may include a first holder member 212 a second holder member 214 that are coupled together. The holder members 214, 214 may be fabricated from a conductive material. As such, the holder members 214, 214 may provide electrical shielding for the first receptacle connector 132. When the holder members 214, 214 are coupled together, the holder members 214, 214 define at least a portion of a shielding structure.

The conductive holder 210 is configured to support a frame assembly 220 that includes a pair of dielectric frames 230, 232. The dielectric frames 230, 232 are configured to surround signal conductors (not shown) that are electrically coupled to or include the receptacle contacts 142. Each signal conductor may also be electrically coupled to or may include a mounting contact 238. The mounting contacts 238 are configured to mechanically engage and electrically couple to conductive vias 262 of the first circuit board 130. Each of the receptacle contacts 142 may be electrically coupled to a corresponding mounting contact 238 through the signal conductor (not shown).

Figure 4:
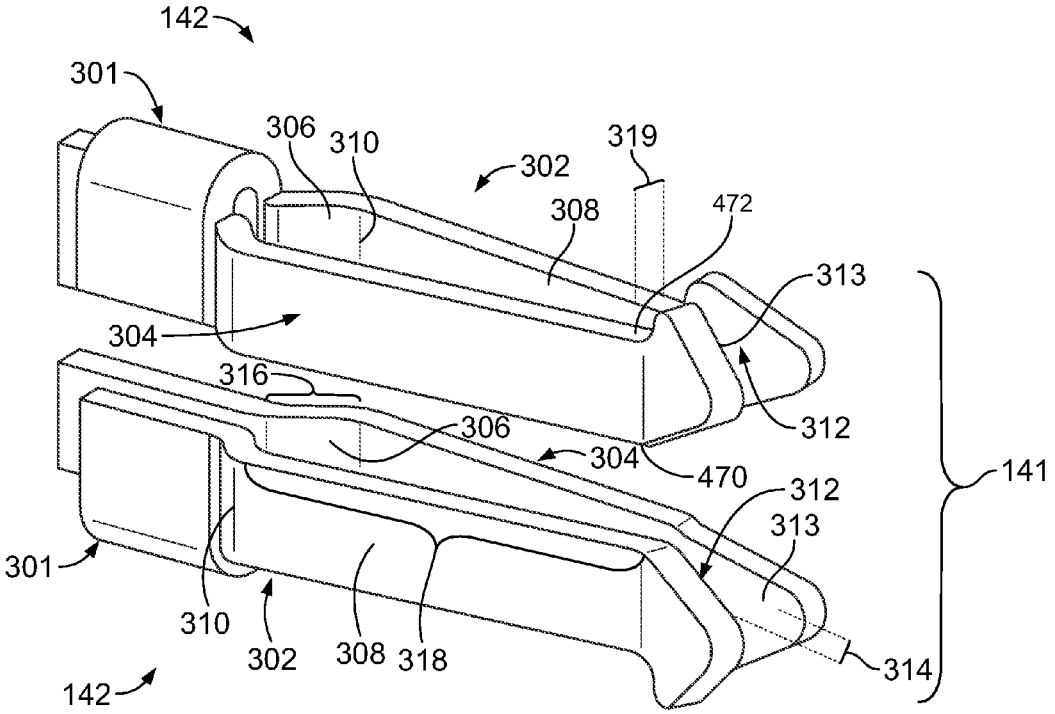
FIG. 4 is an isolated view of receptacle contacts that may be used with the receptacle connector of FIG. 3.

FIG. 4 is an isolated perspective view of a signal pair 141 of two receptacle contacts 142. Each of the receptacle contacts 142 of the signal pair 141 is configured to mechanically and electrical engage a corresponding header contact 120 (FIG. 1) of the same signal pair 121 (FIG. 1). Each of the receptacle contacts 142 may be stamped from a common sheet of material and be shaped to include a contact base 301 and a pair of elongated, flexible contact fingers 302, 304 that project from the corresponding contact base 301.

In the illustrated embodiment, the receptacle contacts 142 are identical. As such, the following description is applicable to each of the receptacle contacts 142. It should be understood, however, that the receptacle contacts 142 of the signal pair 141 are not required to be identical. It should also be understood that the receptacle contacts 142 of the corresponding receptacle connector are not required to be identical. For example, in some embodiments, the receptacle contacts may be configured differently so that the receptacle contacts electrically engage the corresponding header contacts at different times during the mating operation.

Each of the contact fingers 302, 304 includes a base portion 306, a beam portion 308, and a joint portion 310. The beam portions 308 extend to respective mating interfaces 312, which are defined between opposite edge portions 470, 472. The mating interfaces 312 of the contact fingers 302, 304 face each other with a contact-receiving gap 314 therebetween. In the illustrated embodiment, the corresponding mating interfaces 312 of the contact fingers 302, 304 are substantially paddle-shaped or tab-shaped. The mating interface 312 includes a flared portion 313 that extends away from the opposing mating interface 312 to enlarge the contact-receiving gap 314. The curved contour of the mating interfaces 312 and the flared portions 313 may facilitate receiving one of the header contacts 120 (FIG. 1) within the contact-receiving gap 314.

In FIG. 4, the contact fingers 302, 304 are in a relaxed condition or state. During a mating operation between, for example, the first header connector 116 (FIG. 1) and the first receptacle connector 132 (FIG. 1), each of the header contacts 120 (FIG. 1) is received within a contact-receiving gap 314 of a corresponding receptacle contact 142. The opposing mating interfaces 312 may engage opposite body sides of the header contact 120.

When the contact fingers 302, 304 are in deflected conditions, each of the contact fingers 302, 304 may generate a normal force that presses the corresponding mating interface 312 against the corresponding header contact 120 in a direction toward the other mating interface 312. As such, the contact fingers 302, 304 may pinch the corresponding header contact 120 therebetween. To this end, each of the contact fingers 302, 304 may be configured to provide a designated normal force when the corresponding contact finger is in a deflected condition. For example, the base portion 306 may have a designated length 316, the beam portion 308 may have a designated length 318, and the joint portion 310 may have a designated shape or contour. Each of the contact fingers 302, 304 may also have a designated thickness 319. In an exemplary embodiment, the thickness 319 is substantially uniform throughout the corresponding contact finger. The lengths 316, 318, the shape of the joint portion 310, and the thickness 319 may be configured such that each of the contact fingers 302, 304 provides a designated normal force against the header contact 120. The lengths 316, 318 and the shape of the joint portion 310 may also be configured to locate the mating interface 312 at a designated location along the header contact 120 (FIG. 1).

Figure 5:
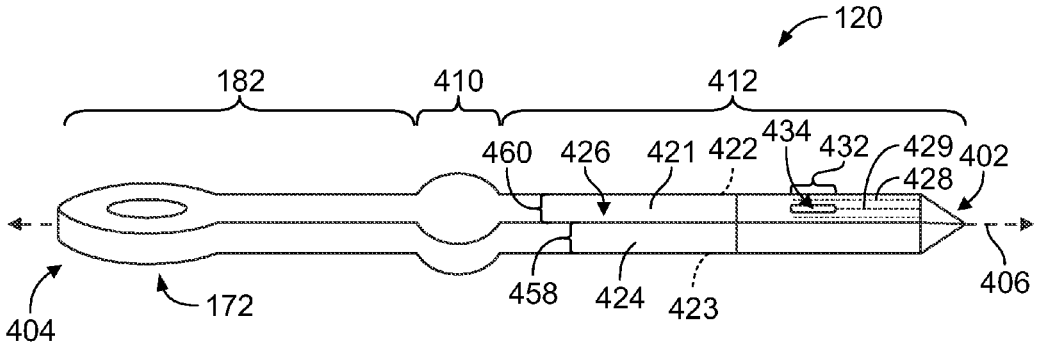
FIG. 5 is an isolated view of a header contact that may be used with the header connector of FIG. 2.

FIG. 5 is an isolated view of an exemplary header contact 120. The header contact 120 includes a distal end or tip 402 and a board end or tail 404. The board end 404 is configured to engage the circuit board 110 (FIG. 1). The distal end 402 may represent the portion of the header contact 120 that is located furthest from the circuit board 110 or the mounting wall 126 (FIG. 1) and is first to engage or interface with another electrical connector, such as the second receptacle connector 152 (FIG. 1). As shown, the header contact 120 has a longitudinal axis 406 extending therethrough between the board end 404 and the distal end 402. For reference, the longitudinal axis 406 extends through an approximate center of the header contact 120.

The header contact 120 may include a contact tail 182 that has the compliant pin 172. The header contact 120 also includes a proximal base 410 that couples to the contact tail 182, and an elongated body 412 that extends from the proximal base 410 to the distal end 402. The contact tail 182 includes the board end 404, and the elongated body 412 includes the distal end 402. As described above, the compliant pin 172 mechanically engages and electrically couples to a corresponding conductive via 170 (FIG. 2) of the circuit board 110 (FIG. 1). The proximal base 410 is sized and shaped to mechanically engage the mounting wall 126 (FIG. 1). For example, the proximal base 410 may be inserted into a passage (not shown) that extends through the mounting wall 126 and engage the mounting wall 126 to form an interference fit therewith. The elongated body 412 may represent the portion of the header contact 120 that is exposed within the housing cavity 164 (FIG. 2).

In the illustrated embodiment, the header contact 120 has a linear structure from the board end 404 to the distal end 402. In other embodiments, however, the header contact 120 may not be linear from the board end 404 to the distal end 402. For example, the elongated body 412 may be linear and extend along the longitudinal axis between the distal end 402 and the proximal base 410 as shown in FIG. 5, but the proximal base 410 may be shaped to reposition the contact tail 182 such that the contact tail 182 is not co-linear with the elongated body 412. In such embodiments, the proximal base 410 may be shaped to facilitate engaging the mounting wall 126 and/or positioning the compliant pin 172 at a designated location. In alternative embodiments, the elongated body 412 is non-linear. For example, the elongated body 412 may have a similar shape as the contact finger 302 (FIG. 4).

In the illustrated embodiment, the elongated body 412 includes body sides 421, 422, 423, 424 that extend generally along the longitudinal axis 406 between the proximal base 410 and the distal end 402. The body sides 421-424 may be exposed within the housing cavity 164 (FIG. 1). The body sides 422, 424 face in opposite directions, and the body sides 421, 423 face in opposite directions. The body side 421 has an exterior surface 426.

The body side 421 is configured to engage a corresponding contact finger, such as one of the contact fingers 302, 304 (FIG. 4), along a wipe track 428 of the exterior surface 426. The wipe track 428 is indicated by dashed lines in FIG. 5. In the illustrated embodiment, the wipe track 428 is not structurally distinct with respect to other features of the body side 421, but represents a portion of the body side 421 that the contact finger engages and wipes along during the mating operation. In other embodiments, the wipe track 428 may be structurally distinct from other features along the body side 421. For example, the wipe track 428 may be similar to the non-linear wipe tracks described in U.S. patent application Ser. No. 14/321,453 in which the wipe tracks are partially defined by recessed portions along the body side. The wipe track 428 may also be similar to the wipe tracks described in U.S. patent application Ser. No. 14/321,395. The wipe track 428 has a path that is represented by a centerline 429. The path is linear in the illustrated embodiment.

The wipe track 428 includes a contact zone 432 that represents an area along the body side 421 that is configured to engage the contact finger after the corresponding receptacle and header connectors are fully mated. More specifically, the contact zone 432 may represent the area that includes the operating position (or final resting position) of the mating interface 312 (FIG. 4) as data signals are transmitted through the communication system 100 (FIG. 1). In order to account for tolerances in the manufacturing and assembly of the receptacle and header connectors, the contact zone 432 may be sized larger than the mating interface 312.

Also shown, the body side 421 includes an indentation 434 that is located within or proximate to the contact zone 432. The indentation 434 is a portion of the exterior surface 426 that is recessed or depressed with respect to the surrounding portion of the exterior surface 426. The indentation 434 is configured to retain or store a pore-blocking substance 436 (shown in FIGS. 6 and 7). In some embodiments, the indentation 434 may function as a reservoir that maintains a sufficient amount of the pore-blocking substance 436 along portions of the exterior surface 426 that directly engage the contact finger 304 (or 302) in the operating position. The indentation 434 may be positioned, sized, and shaped relative to the contact finger 304 so that the mating interface 312 engages a portion of the exterior surface 426 and extends at least partially over the indentation 434. As shown, the body side 421 has a single indentation 434. In other embodiments, the body side 421 may have multiple indentations.

Although the above description was with respect to the body side 421, the body side 423 may have similar features. In an exemplary embodiment, the body sides 421, 423 have identical configurations. For example, if the header contact 120 were rotated 180° about the longitudinal axis 406, the elongated body 412 would have the same appearance as shown in FIG. 5. The elongated body 412, however, is not required to have identical configurations along the body sides 421, 423 and may have different configurations in other embodiments.

In an exemplary embodiment, the header contact 120 is stamped (or coined) from sheet metal having opposite side surfaces with a thickness extending therebetween. When the header contact 120 is stamped, the body sides 421, 423 may be formed from the opposite side surfaces of the sheet metal, and the body sides 422, 424 may be edges formed by the stamping process. The stamping process may also provide the indentations 434. Alternatively, the indentation 434 may be formed before or after the stamping process that provides the body sides 421-424. The elongated body 412 may have a substantially uniform body thickness 458 that is measured between the first and second body sides 421, 423, and a body width 460 that is measured between the body sides 422, 424. In an exemplary embodiment, the thickness 458 and the body width 460 are substantially equal. However, the body width 460 and the thickness 458 may not be equal in other embodiments.

After stamping an unfinished header contact 120 from the sheet metal, the header contact 120 may be treated to include one or more designated coatings. By way of example, the sheet metal may include a copper alloy. After stamping a base material from the sheet metal, a first coating (not shown) may be applied directly to the base material (e.g., the stamped copper alloy). A second coating (not shown) may be applied onto the first coating. The first and second coatings may be applied using, for example, an electroplating process. In an exemplary embodiment, the first coating includes nickel or tin and functions as a diffusion barrier between the base material and the second coating. The second coating may include gold. In an exemplary embodiment, the gold is plated from the distal end 402 to a location beyond the contact zone 432. Optionally, the gold may be selectively located at the contact zone 432 and not between the distal end 402 and the contact zone 432.

After the second coating is applied, the pore-blocking substance 436 (FIGS. 6 and 7) may be applied to the header contacts 120. The pore-blocking substance 436 may be applied to the body side 421 such that the exterior surface 426 includes a thin layer of the pore-blocking substance 436 and the indentation 434 includes a larger volume or reservoir of the pore-blocking substance 436. Various methods may be used to apply the pore-blocking substance 436, such as spraying, brushing, dipping, and the like. The pore-blocking substance 436 is configured to reduce corrosion along the exterior surface 426 of the header contact 120. In some cases, the pore-blocking substance 436 may also function as a lubricant. Examples of pore-blocking substances that may be used with embodiments described herein include at least one of a polysiloxane (e.g. dimethyl polysiloxane, phenylmethyl polysiloxane), silicate ester, polychlorotrifluoro-ethylene, di-ester, fluorinated ester, glycol, chlorinated hydrocarbon, phosphate ester, polyphenyl ether, perfluoroalkyl polyether, poly-alpha-olefin, petroleum oil, organometallic compound, benzotriazole (BTA), mercaptobenzotriazole, self-assembled monolayer (SAM), or microcrystalline wax. Proprietary pore-blocking substances may also be used, such as D-5026NS/ZC-026 by Zip-Chem. It should be understood that the pore-blocking substances are provided above as non-limiting examples and other pore-blocking substances may be used. Moreover, a combination of pore-blocking substances, such as those provided above, may be used. It should also be understood that certain pore-blocking substances may not be suitable for some applications.

Figure 6:
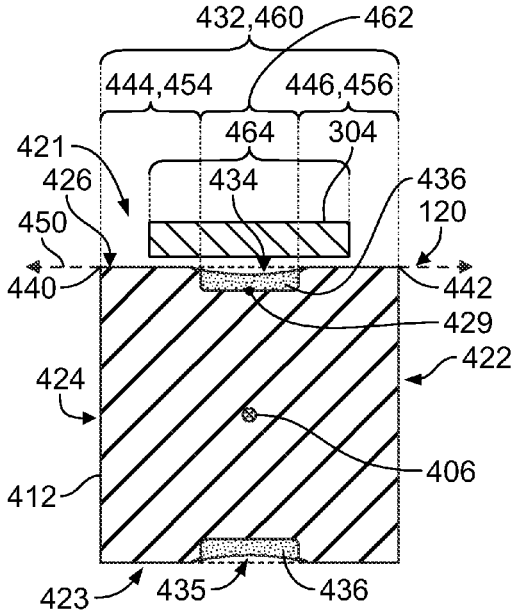
FIG. 6 is a cross-section of the header contact taken transverse to a longitudinal axis while the header contact is engaged to a corresponding mating contact.
Figure 7:
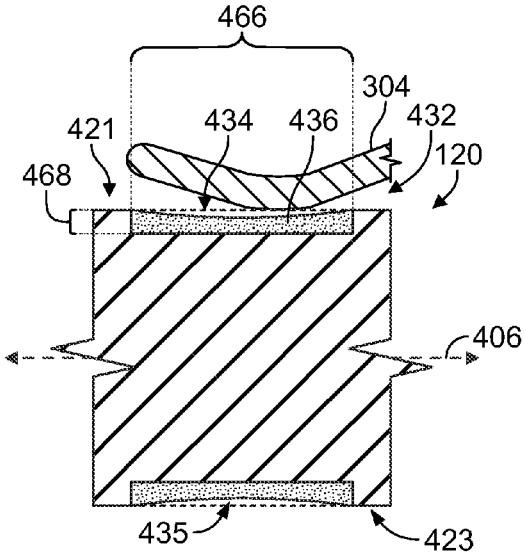
FIG. 7 is a side cross-section of the header contact taken along the longitudinal axis while the header contact is engaged to the corresponding mating contact.

FIG. 6 is a cross-section of the header contact 120 taken transverse to the longitudinal axis 406 when the contact finger 304 (shown in cross-section) is in an operating position with respect to the header contact 120. For illustrative purposes, the contact finger 304 is slightly separated from the header contact 120 in FIG. 6, but it should be understood that the contact finger 304 would engage the header contact 120 when in the operating position. FIG. 7 is a side cross-section of a portion of the header contact 120 as the contact finger 304 is engaged to the header contact 120 at the operating position. Each of FIGS. 6 and 7 illustrates the indentation 434 along the body side 421 and an indentation 435 along the body side 423. For illustrative purposes, only one of the contact fingers 304 is shown engaging the body side 421, but it should be understood that another contact finger, such as the contact finger 302 (FIG. 5), may engage the body side 423. Moreover, the following description with respect to the body side 421 may be similarly applicable to the body side 423.

With respect to FIG. 6, the body side 421 is defined between opposite side edges 440, 442 of the elongated body 412. The side edge 440 may represent where the body sides 421, 424 join each other, and the side edge 442 may represent where the body sides 421, 422 join each other. The body side 421 is shaped such that the indentation 434 is located between first and second contact areas 444, 446 of the exterior surface 426. The first and second contact areas 444, 446 are portions of the exterior surface 426 that may directly engage the contact finger 304 when the contact finger 304 is in the operating position. The first contact area 444 extends laterally between the side edge 440 and the indentation 434, and the second contact area 446 extends laterally between the side edge 442 and the indentation 434. In the illustrated embodiment, the first and second contact areas 444, 446 substantially coincide with a common plane 450. In particular embodiments, the entire contact zone 432, except for the indentation 434, coincides with the common plane 450.

When the contact finger 304 directly engages one or both of the contact areas 444, 446, an electrical connection between the contact finger 304 and the header contact 120 is established. The body side 421 and the contact finger 304 are dimensioned relative to each other such that the contact finger 304 directly engages at least one of the contact areas 444, 446 and the contact finger 304 extends laterally over at least a portion of the indentation 434. In the illustrated embodiment, the contact finger 304 extends laterally over the entire indentation 434 and engages each of the contact areas 444, 446. In other embodiments, however, the contact finger 304 may extend laterally over only a portion of the indentation 434 and/or engage only one of the contact areas 444, 446.

In particular embodiments, the indentation 434 is centrally located along the body side 421. For example, the centerline 429 may represent a line that extends along the elongated body 412 and intersects midpoints between the side edges 440, 442. The centerline 429 may extend through the indentation 434. In the illustrated embodiment, the centerline 429 extends through a center of the indentation 434.

Also shown in FIG. 6, the contact area 444 has a width 454, and the contact area 446 has a width 456. The widths 454, 456 are substantially equal in the illustrated embodiment. However, in other embodiments, the indentation 434 may be located closer to the side edge 440 or closer to the side edge 442 such that the widths 454, 456 are not equal. The body width 460 is measured between the side edges 440, 442, and the indentation 434 has a width 462. Each of the widths 454, 456, 460, 462 is measured transverse to the longitudinal axis 406. In some embodiments, the width 462 of the indentation 434 is approximately 20% to 40% of the width 460 of the body side 421.

The contact finger 304 also has a width 464 that may be measured transverse to the longitudinal axis 406 when the contact finger 304 is in the operating position. In the illustrated embodiment, the width 464 of the contact finger 304 is greater than the width 462 of the indentation 434. For example, the width 464 may be at least about 1.5 times (1.5×), at least about 2.0 times (2×), or at least about 2.5 times (2.5×) the width 464 of the indentation 434.

With respect to FIG. 7, the indentation 434 has a length 466 that is measured along the longitudinal axis 406. The length 466 may be configured to accommodate for tolerances in the manufacturing and assembly of the corresponding electrical connector to increase the likelihood that the contact finger 304 will be positioned over the indentation 434. In some embodiments, the length 466 is at least about 1.5 times (1.5×) the width 462 (FIG. 6), at least about 2.5 times (2.5×) the width 462, or at least about 3.5 times (3.5×) the width 462. As such, the indentation 434 may be an elongated trough in some embodiments. The indentation 434 has a depth 468, which is uniform in the illustrated embodiment, but may be non-uniform in other embodiments. In some embodiments, the width 462 (FIG. 6), the length 466, and the depth 468 of the indentation 434 are configured such that indentation 434 is capable of retaining a designated volume of the pore-blocking substance 436 within the indentation 434.

It is understood that tolerances during the manufacture and assembly of the communication system 100 (FIG. 1) may render it difficult to locate the mating interface 312 (FIG. 4) of the contact finger 304 at a designated position. For instance, the various tolerances during manufacture and assembly may effectively result in some mating interfaces 312 being located at a first end of the indentation 434, other mating interfaces 312 being located at a middle of the indentation 434, and other mating interfaces 312 being located at a second end of the mating interfaces 312. Likewise, various tolerances may effectively result in some mating interfaces 312 being located closer to the side edge 440 (FIG. 6), some mating interfaces 312 being located closer to the side edge 442 (FIG. 6), and some mating interfaces 312 being located within the middle of the body side 421. Accordingly, the length 466 of the indentation 434 and the width 462 of the indentation 434 may be configured to increase the likelihood that all fingers 304 will directly engage the header contact 120 at the contact zone 432.

Figure 8:
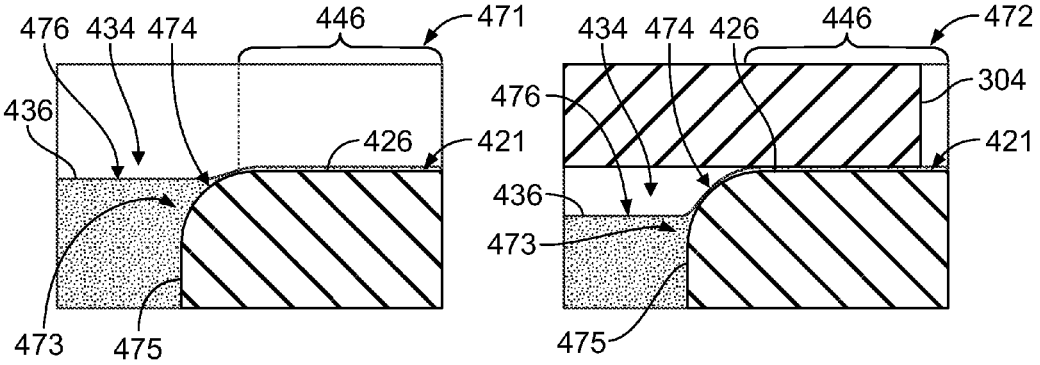
FIG. 8 shows different stages of the header contact and illustrates a wicking action that may occur to provide a sufficient amount of pore-blocking substance along the header contact.

FIG. 8 illustrates enlarged cross-sections of the body side 421 at different stages 471, 472 during a lifetime of the header contact 120 (FIG. 1). For example, stage 471 may represent the body side 421 prior to reduction of the pore-blocking substance 436, such as immediately after the header contact 120 is formed. As shown, the pore-blocking substance 436 is located within the indentation 434 and along the contact area 446. Although not shown, the pore-blocking substance 436 may also be located along the contact area 444 (FIG. 6). Stage 472 may represent the body side 421 after a portion of the pore-blocking substance 436 has been removed. As described herein, the pore-blocking substance 436 may be removed through evaporation and/or when the body side 421 physically engages other objects, such as a connector housing or the contact finger 304.

At stage 471, the indentation 434 holds a designated volume of the pore-blocking substance 436. As shown, the indentation 434 may be partially defined by an interior sidewall 473 that includes a transition area 474 and a bottom portion 475. The transition area 474 extends between the contact area 446 and the bottom portion 475 of the sidewall 473. The interior sidewall 473 may be part of the exterior surface 426. For example, the interior sidewall 473 and the contact area 446 may be part of a common side surface of the sheet metal prior to the stamping process. The interior sidewall 473 may be formed by the stamping process.

In some embodiments, the transition area 474 is shaped to permit wicking of the pore-blocking substance 436 from the indentation 434 to the contact area 446. The transition area 474 may be substantially smooth such that wicking is facilitated along the transition area 474. For example, the transition area 474 may have a substantially curved contour relative to the bottom portion 475. The bottom portion 475 may be more planar than the transition area 474 and/or may be substantially perpendicular to the plane 450 (FIG. 6). In some embodiments, the transition area 474 and the bottom portion 475 of the sidewall 473 have similar shapes or contours.

Stages 471 and 472 illustrate the wicking action that may occur in some embodiments. At stage 471, the pore-blocking substance 436 forms a fill line 476 within the indentation 434 that is substantially flush with the contact area 446. At stage 472, a portion of the pore-blocking substance 436 has moved from the indentation 434 to the contact area 446 causing the fill line 476 to lower. Without being held to a particular theory or mechanism, it is believed that the pore-blocking substance 436 may move from the indentation 434 to the contact area 446 because of inherent properties of the pore-blocking substance 436 and a surface energy of the exterior surface 426 and/or the contact finger 304. More specifically, the pore-blocking substance 436 may have cohesive forces that draw the pore-blocking substance 436 to itself and may have adhesive forces with respect to the contact area 446 and a surface of the contact finger 304. As such, the pore-blocking substance 436 may be drawn from the indentation 434 and onto the contact area 446. The wicking action may be similar to capillary action. Accordingly, embodiments set forth herein may be capable of retaining a sufficient amount of the pore-blocking substance 436 along the contact area 446, which may reduce the likelihood of corrosion developing along the header contact 120 (FIG. 5).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector housing configured to engage a mating connector during a mating operation; and a plurality of electrical contacts coupled to the connector housing, each of the electrical contacts including a proximal base coupled to the connector housing and an elongated body that extends from the proximal base to a distal end, the elongated body having a body side that extends between the proximal base and the distal end and is configured to engage a corresponding mating contact of the mating connector, the body side having an exterior surface that includes a stamped indentation, wherein each of the electrical contacts includes a pore-blocking substance within the corresponding stamped indentation and along a surrounding portion of the exterior surface that is adjacent to the corresponding stamped indentation.

2. The electrical connector of claim 1, wherein the stamped indentation is partially defined by a sidewall of the body side and the body side includes a contact area that is configured to directly engage the corresponding mating contact, the sidewall including a transition area that is configured to facilitate wicking of the pore-blocking substance from the stamped indentation to the contact area.

3. The electrical connector of claim 1, wherein the body side is defined between opposite side edges of the elongated body and includes a contact area of the exterior surface that extends between one of the side edges and the stamped indentation, the body side being shaped such that the mating contact engages the contact area and extends at least partially over the stamped indentation.

4. The electrical connector of claim 1, wherein the body side is defined between opposite side edges of the elongated body and has a centerline that extends therebetween, the centerline extending through the stamped indentation.

5. The electrical connector of claim 1, wherein the elongated body extends along a longitudinal axis, the stamped indentation having a length measured along the longitudinal axis and a width that is measured transverse to the longitudinal axis, the length of the stamped indentation being at least 1.5 times the width of the stamped indentation.

6. The electrical connector of claim 1, wherein the mating contact is configured to engage the body side at a contact zone, the contact zone having a plating that includes pores, the pore-blocking substance configured to impede matter from entering the pores and developing corrosion.

7. The electrical connector of claim 1, wherein the body side has a contact zone that includes the stamped indentation and that is configured to engage the mating contact during operation of the electrical connector, the contact zone including first and second contact areas that are located on opposite sides of the stamped indentation, the first and second contact areas coinciding with a common plane.

8. The electrical connector of claim 1, wherein the electrical contact includes a stamped base material that includes a depression, the electrical contact further comprising at least one coating along at least a portion of the body side, wherein the at least one coating along the depression defines the indentation.

9. A communication system comprising:

a first electrical connector comprising a plurality of first electrical contacts; and a second electrical connector comprising a plurality of second electrical contacts that are configured to engage corresponding first electrical contacts of the first electrical connector during a mating operation between the first and second electrical connectors, each of the second electrical contacts including a proximal base and an elongated body that extends from the proximal base to a distal end, the elongated body having a body side that extends between the proximal base and the distal end and is configured to engage a corresponding first electrical contact of the first electrical connector, the body side having an indentation, wherein each of the second electrical contacts includes a pore-blocking substance within the corresponding indentation, wherein the body side includes a wipe track, the corresponding first electrical contact configured to engage and wipe along the wipe track, the wipe track including at least a portion of the indentation.

10. The communication system of claim 9, wherein the indentation is partially defined by a sidewall of the body side and the contact area is configured to directly engage the corresponding first electrical contact, the sidewall including a transition area that is configured to facilitate wicking of the pore-blocking substance from the indentation to the contact area.

11. The communication system of claim 9, wherein the body side is defined between opposite side edges of the corresponding second electrical contact and includes a contact area that extends between one of the side edges and the indentation, the corresponding first electrical contact engaging the contact area and extending at least partially over the indentation when the first and second electrical connectors are fully mated.

12. The communication system of claim 9, wherein each of the second electrical contacts includes a stamped base material that includes a depression, the second electrical contact further comprising at least one coating along at least a portion of the body side, wherein the at least one coating along the depression defines the indentation.

13. The communication system of claim 9, wherein the body side is defined between opposite side edges of the corresponding second electrical contact and has a centerline that extends therebetween, the centerline extending through the indentation.

14. The communication system of claim 9, wherein the elongated body extends along a longitudinal axis, the indentation having a length measured along the longitudinal axis and a width that is measured transverse to the longitudinal axis, the length of the indentation being at least 1.5 times the width of the indentation.

15. The communication system of claim 9, wherein the first electrical contact is configured to engage the body side at a contact zone, the contact zone having a plating that includes pores, the pore-blocking substance configured to impede matter from entering the pores and developing corrosion.

16. An electrical contact comprising a proximal base that is configured to couple to a connector housing and an elongated body that extends from the proximal base to a distal end, the elongated body having a body side that extends between the proximal base and the distal end and is configured to engage a mating contact, the body side having an indentation, wherein the elongated body includes a pore-blocking substance within the indentation, wherein the body side includes a contact area alongside the indentation and a transition area that extends between the pore-blocking substance within the indentation and the contact area, the contact area positioned for engaging the mating contact, the transition area shaped to facilitate wicking of the pore-blocking substance from the indentation to the contact area.

17. The electrical contact of claim 16, wherein the contact area is a first contact area and the body side includes a second contact area, the first and second contact areas being located on opposite sides of the indentation, the first and second contact areas coinciding with a common plane.

18. The electrical contact of claim 16, wherein the body side has a plating that includes pores, the pore-blocking substance configured to impede matter from entering the pores and developing corrosion.

19. The electrical contact of claim 16, wherein the transition area has a curved surface.

20. The electrical contact of claim 16, wherein the electrical contact includes a stamped base material that includes a depression, the electrical contact further comprising at least one coating along at least a portion of the body side, wherein the at least one coating along the depression defines the indentation.

* * * * *